United States Patent [19]

Pearson et al.

[11] 4,150,594

[45] Apr. 24, 1979

[54] APPARATUS FOR HANDLING CUTTINGS FROM A SHEAR

[75] Inventors: Eugene W. Pearson, Orinda, Calif.; Wilbur G. Short, Browns, Ill.

[73] Assignee: Canron, Inc., Oakland, Calif.

[21] Appl. No.: 703,617

[22] Filed: Jul. 8, 1976

[51] Int. Cl.[2] ..... B26D 7/18

[52] U.S. Cl. ..... 83/91; 83/94; 83/104; 83/106; 83/167; 83/165

[58] Field of Search ..... 83/89, 90, 91, 94, 104, 83/106, 731, 167, 166, 165

[56] References Cited

U.S. PATENT DOCUMENTS

| | | | |
|---|---|---|---|
| 430,892 | 6/1890 | Shimer | 83/167 |
| 872,383 | 12/1907 | Slick | 83/104 |
| 3,111,146 | 11/1963 | Schnepel | 83/731 |
| 3,830,121 | 8/1974 | Makeev et al. | 83/94 |
| 3,866,498 | 2/1975 | Jarman | 83/94 |
| 4,040,318 | 8/1977 | Makeev et al. | 83/91 |

*Primary Examiner*—Donald R. Schran

[57] ABSTRACT

A car on tracks behind the knives of a shear machine, has a section for receiving product cuttings when the car occupies one position on the tracks, and means are provided for receiving scrap cuttings when said car is moved to another position, the car being capable of additional movement on said tracks to a position to the rear of the machine for convenient disposal of cuttings carried by it. Work support means carried by the car, supports work prior to shearing and, when possessed of magnetic qualities, will magnetically grip the work and enable adjustment thereof for shearing, by movement of the car. In lieu of magnet work supports, roller supports may be provided, and such roller supports may be power driven.

29 Claims, 20 Drawing Figures

APPARATUS FOR HANDLING CUTTINGS FROM A SHEAR

The invention relates to shear machines or the like and more particularly to work adjusting and cutting handling means for use in association with such machines.

In the absence of any provision for handling cutting from a shear machine, whether scrap cuttings or product cuttings, the cuttings will fall to the floor, where they not only become mixed and must be sorted, but the handling of such cuttings become a difficult and hazardous project because of the weight thereof, the limited space available for performing such maneuvers, and the inevitable overhead presence of machine parts.

Attempts to ameliorate the situation have resulted in development of conveyors which carry such cuttings to the rear of the machine for separation and disposal. However, aside from the necessity of subsequent separation of scrap cuttings from product cuttings, the conveyors must be rugged because of the heavy loads to which they must be exposed, and they therefore, become costly.

Among the objects of the invention are:

(1) To provide novel and improved cutting handling means for a shear or like machine;

(2) To provide novel and improved cutting handling assembly which enables sorting of the scrap cuttings from the product cuttings of a shear or like machine;

(3) To provide novel and improved adjustable back-gauge assembly for a shear or like machine;

(4) To provide novel and improved work adjusting means which is applicable to a shear or like machine;

(5) To provide novel and improved cutting handling means and work adjusting means in combination for a shear or like machine, (6) To provide novel and improved cutting handling means, work adjusting means, and an adjustable back-gauge assembly in combination for a shear or like machine;

(7) To provide novel and improved combination of a shear machine and cutting handling means.

Additional objects of the invention will be brought out in the following description of the same, taken in conjunction with the accompanying drawings wherein.

Figure 1:
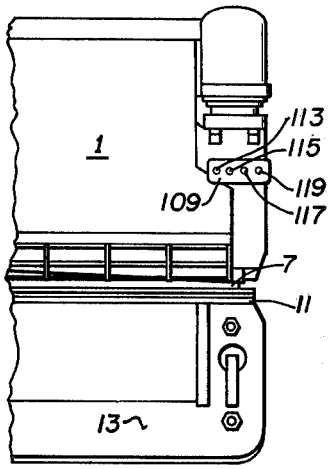
FIG. 1 is a fragmentary front view in elevation of a shear machine with the invention installed.
Figure 2:
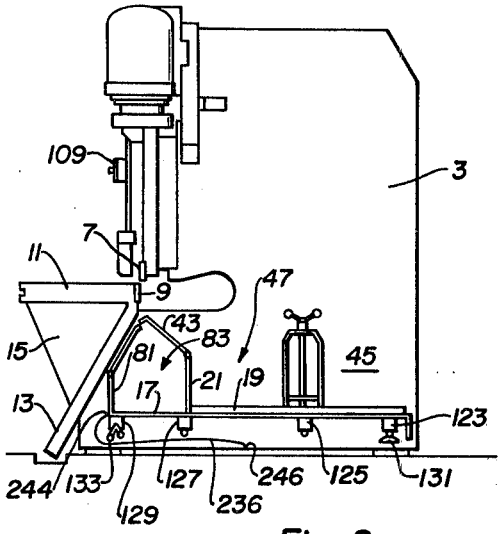
FIG. 2 is a side view of the machine with one end removed to expose features of the invention.
Figure 3:
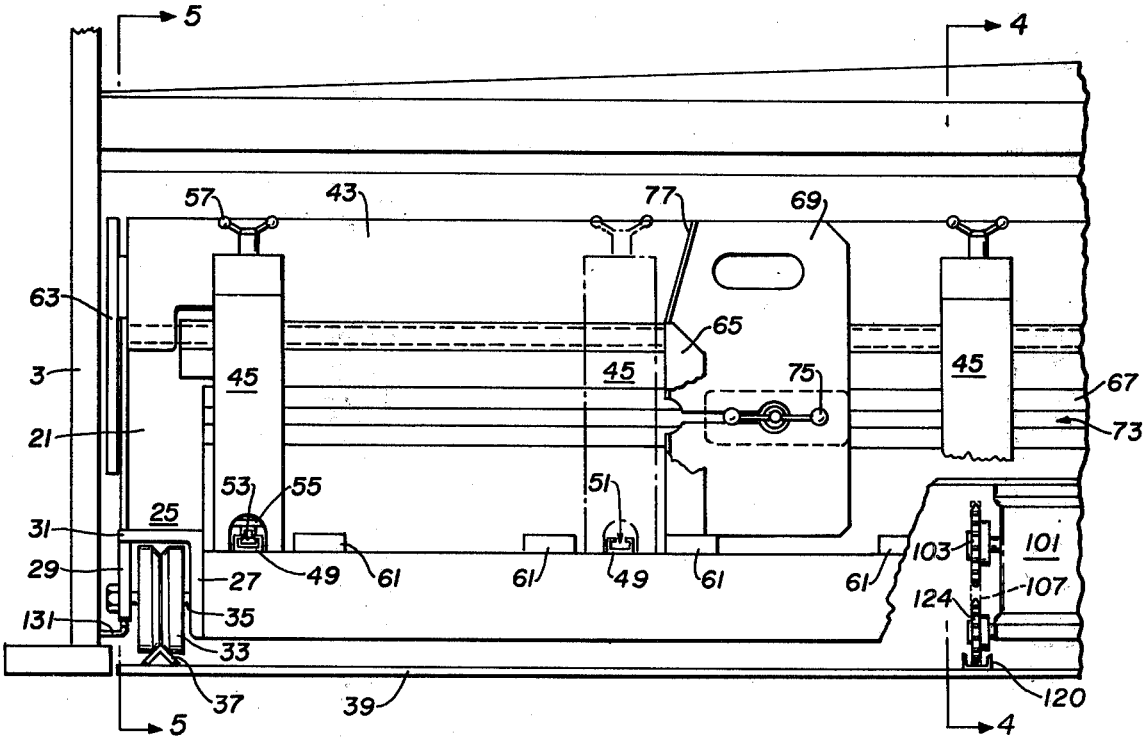
FIG. 3 is a rear view in elevation of a transfer car depicting various features of the invention in detail.

Fundamental to the invention in its various forms, we employ a car disposed behind the knives of a shear machine and extending from one end of the knives to the other end, such car having at least one compartment adapted to receive product cuttings of different widths and varying in length from the smallest piece to a length approaching the length of the shear blades.

After receiving the cuttings, the car is adaptable for movement along tracks to the rear of the machine where the product cuttings may be removed for disposal.

In one form of the invention, wherein the car is adapted for movement to the rear of the machine for disposal of the cuttings, the car may be provided with a second comparment adapted to receive scrap cuttings.

In lieu of such second compartment, however, a pit may be provided in the floor just behind the knives of the machine, in which pit, may be disposed a second car on tracks running parallel to the knives, such car being adapted to receive scrap cuttings when the first car is removed from its product collecting position, to expose the pit.

The car, in either of these forms of the invention, may include a support for supporting work or a support for adjusting rollers, and a mounting for a back-gauge stop, such back-gauge stop in conjunction with the car, constituting an adjustable back-gauge assembly.

For details of the invention, reference will be made to the drawings, wherein the invention depicted as applied to a shear machine 1 of the type having a pair of side housings 3 and 5 spanned by work modifying means, such as an upper knife 7 and lower knife 9 in shearing relationship to each other, and between which, sheet metal may be fed from a table 11 at the front of the machine toward the knives, such table constituting a component of a table assembly including a supporting front wall 13, sloping at an acute angle from the rear edge of the table, downwardly toward the front and reinforced by gussets 15 within the acute angle between the table and the sloping wall.

A transfer car assembly disposed behind the knives, including a bed of substantially the width of the machine and preferably sectioned into two portions 17, 19, the front portion 17 preferably elevated above the rear to accommodate a drive means, and divided from each other by a dividing wall 21.

Mounted along each side of the bed is a wheel guard assembly 25 in the shape of an inverted channel, comprised of two side walls 27, 29 spanned by a top piece 31 and enclosing a series of grooved wheels 33 rotatably mounted on axles 35 affixed through such side walls.

The grooved rim of each of such wheels provides a complementary fit to a rail 37 formed of angle iron affixed to a sheet metal base 39, the rail extending from under the sloping front wall of the machine to substantially beyond the rear.

Figure 7:
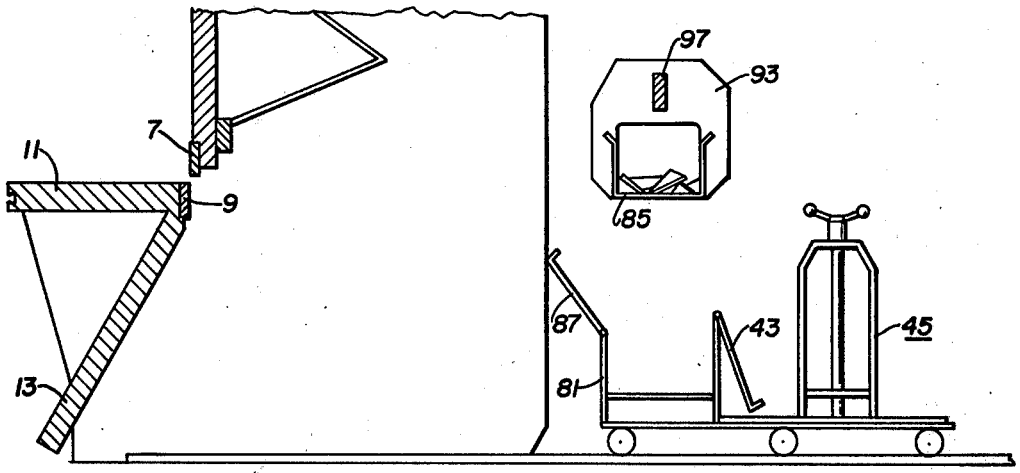
FIG. 7 is a view in section of a transfer car in scrap unloading position.
Figure 9:
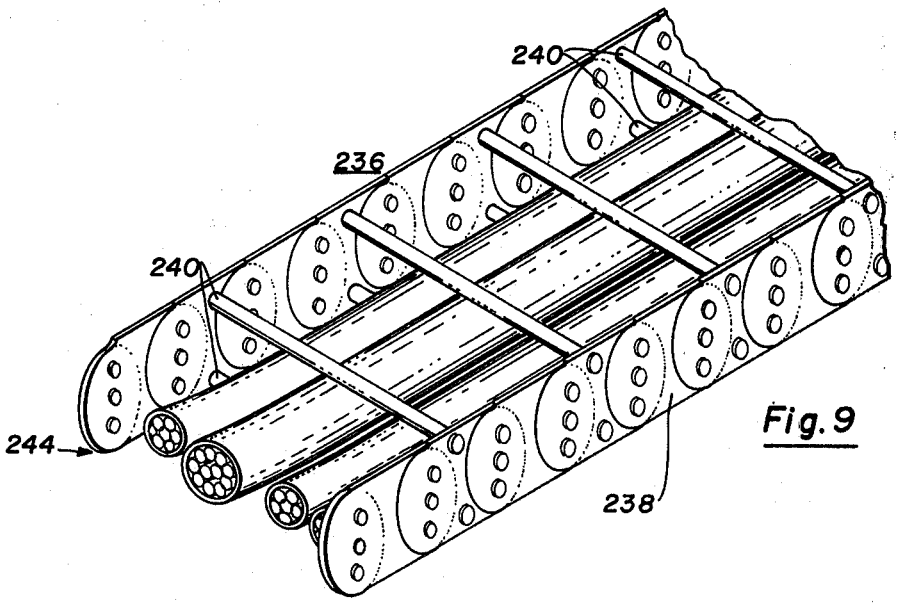
FIG. 9 is an isometric fragmentary view of a flexible cable carrier employed in the invention.

The car is, therefore, movable from the first or product collecting position (FIG. 4) under the sloping front wall, to a position completely withdrawn from behind the machine (FIG. 7), and can be stopped at any intermediate position therein to facilitate collecting and unloading of product and scrap.

The dividing wall 21 includes an upper portion composed of a preferably hinged segment 43, angled toward the knives of the machine. In the extreme forwardmost position of the car, this angled segment of the dividing wall is essentially under the lower shear knife 9 and functions as a chute to guide the work product into a stacked position behind such dividing wall, such stacking being facilitated by a plurality of back-stop assemblies 45 located to the rear of this wall, to form a product collecting section 47 of the car.

Each backstop assembly 45 is adjustably movable along a track formed by a box channel 49 affixed along the rear portion of the floor of the car 19 and provided with a slot 51 to slidably receive the head end of a bolt 53 extending upward through the base of a back-stop 55, to receive at its upwardly exposed end, a clamping handle 57. In the loose condition of the clamping handle, the associated back-stop assembly may be adjusted as to position along the track and secured in a selected position, by tightening of the clamping handle. When product cuttings are short in length, all back-stop assemblies are not needed. When the necessary back-stop assemblies are properly adjusted, they effectively form a wall of the product collecting section 47.

A protective rail 61, slightly higher than the channel 49, and attached to the floor of the car essentially parallel to and on either side of the channel 49, protects such channel from damage against failing pieces.

The wheel guard assemblies 25, when mounted to the car sides with the top piece 31 at the same elevation as the protective rail 61, will serve to give protection to the outermost channel.

The product collecting section has a fixed side wall 63 at one end and toward the opposite end, an adjustable side wall 65 mounted on a guide rail 67 running along the dividing wall 21. Such adjustability permits of adjusting the product section to the length of the product cuttings.

A right angle section 69 of the adjustable wall lies parallel to the guide rail, and a bolt 71 slidably installed headfirst in a guide groove 73 of the rail, passes through the right angle section, whereby a tightening handle 75 on the bolt may be used to lock the adjustable wall in any desired position. By angling the upper portion 77 of the adjustable side wall in an outwardly direction, the product cuttings will be effectively guided and stacked.

Figure 5:
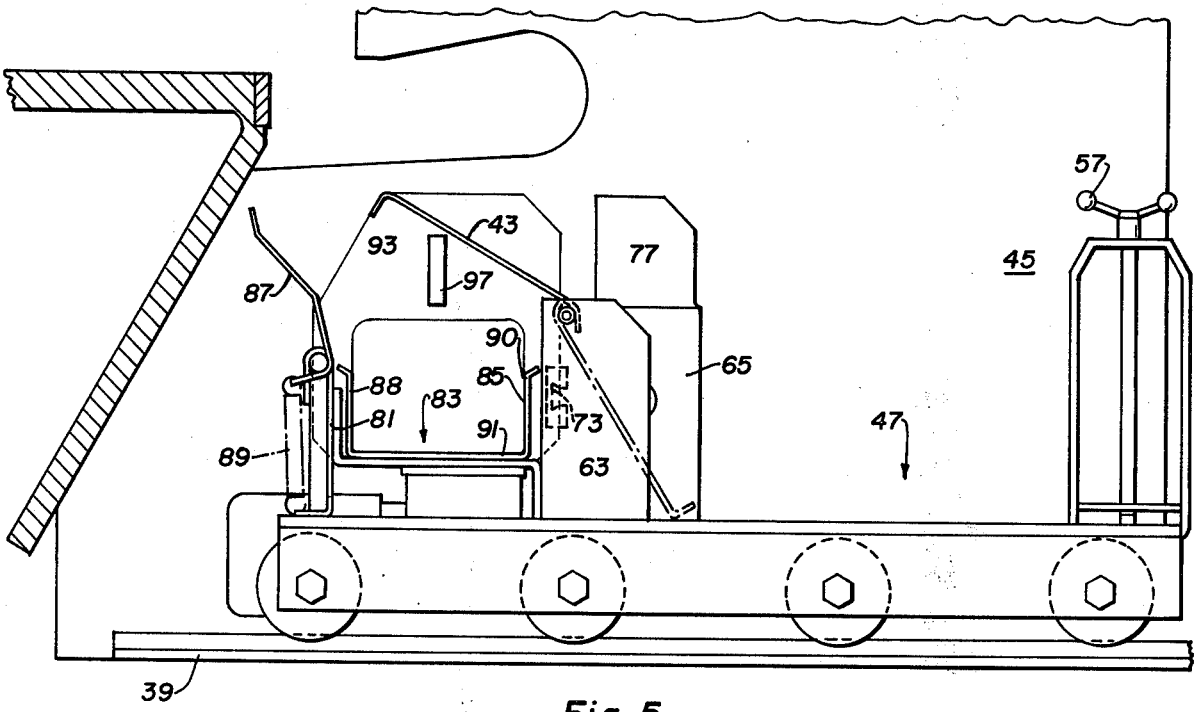
FIG. 5 is a view in section in the plane 5—5 of FIG. 3 showing the transfer car in a scrap collecting position.

When the car is moved rearwardly from its product collecting position, the front portion of the car bed 17 becomes exposed to the knives in position to receive scrap cuttings (FIG. 5).

For this purpose, the car is provided with a front wall 81, which, with the dividing wall 21, forms a scrap receiving section 83, in which a receptacle or bucket 85 may be disposed to catch such cuttings.

The front wall 81 includes a hinged section 87, biased by a spring 89 to a limited position in the forward direction to engage the sloping front wall 13 of the machine which, as the car moves in to the product collection position, causes the hinged section of the front wall to move upward out of the way.

As the car moves rearwardly from its product collecting position to expose the scrap receiving section 83, the spring biased hinged section 87 of the front wall restores itself to its previous angular position where it now functions as a chute in guiding scrap cuttings to the scrap collecting section.

The bucket 85 is adapted to fit into the scrap collecting section, and includes a front wall 88 and a back wall 90, parallel to dividing wall 21 and joined by a bottom 91 to form a trough, the ends of this trough being spanned by end walls 93, which overlap the dividing wall and front wall, one of the end walls being provided with a discharge opening 95 for elimination of scrap cuttings. A bar or bail 97 extending between and joined to the upper extremities of the end walls 93, are provided with spaced openings 99 to receive the arms of a fork lift or the hooks of a crane to remove the bucket for disposal of the cuttings.

Further withdrawal of the car toward the rear of the machine provides a product unloading, (FIG. 6) or third position where the rear compartment is stopped just beyond the rear of the machine. In such position, stacked product cuttings are readily exposed for easy removal by crane, fork lift, or any other appropriate means, the use of which otherwise, would be impractical because of limited space within the machine area.

Additional withdrawal of the car eventually expose the first or scrap collection section beyond the rear limit of the machine. In this, the fourth position (FIG. 7), with the hinged segment 43 of the dividing wall rotated rearward, the scrap bucket is readily accessible for removal.

Figure 4:
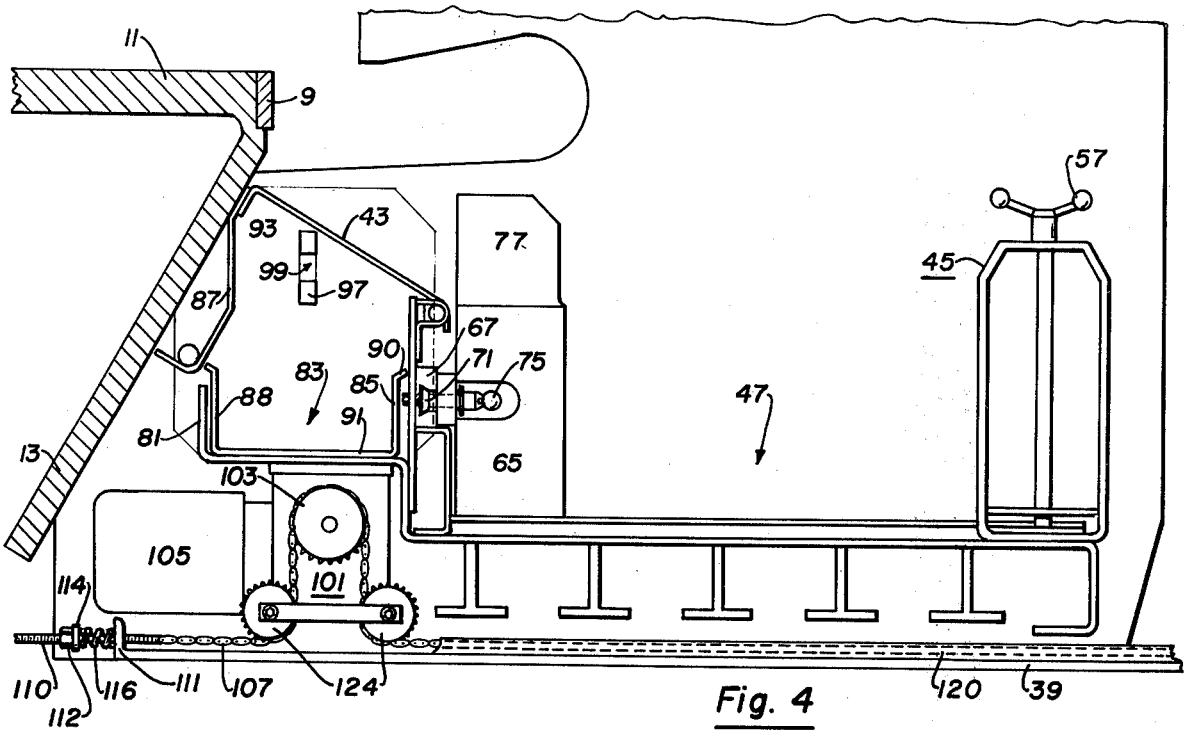
FIG. 4 is a view in section in the plane 4—4 of FIG. 3 showing the transfer car in a product collecting position.

Positioning of the car to any of its described positions, is readily accomplished as depicted in FIG. 4, where a reduction gear assembly 101 coupled to a drive sprocket 103 and its associated bi-directional drive motor 105, is mounted intermediate the underside of the raised bed of the first section 83. A roller chain 107, similar to that of a motorcycle or bicycle drive chain, having links 108 including openings for engagement with sprocket teeth, terminates at one end in a threaded shaft 110, insertable through an opening in an end block 111 anchored to the floor, and secured with a nut 112 and washer 114 against an interposed spring 116. Such arrangement, coupled with the other end of the chain being firmly mounted to a fixed block 118 secured to the floor at the rear of the machine, provides a tension adjustability feature to the chain. Such chain being housed in a support channel 120 affixed to the sheet metal base 39, is looped over the drive sprocket 103 and maintained in position with the aid of idler sprockets 124 disposed on either side of such drive sprocket.

Rotation in either direction of the drive sprocket, because of the fixed condition of the roller chain and the movable condition of the car, causes the sprocket gear to drive the car along such chain, thereby affecting controllable movement of the car.

Control of such movement is through a control station 109 typically located on the front of the shear machine within easy access of an operator.

The station contains an indicator push-button for each of the functioning positions of the car, e.g., the product collecting position button 113, the scrap collecting button 115, the product unloading position button 117, and the scrap unloading position button 119. Depression of the appropriate push-botton, causes the car to move in the correct direction toward the appropriate position. An indicator light contained within each push-button will illuminate when the car has arrived at the desired position which is defined by activating one of a plurality of limit switches 123, 125, 127, 129 physically spaced and attached to the wheel guard assembly, in actuating alignment with a cam 131 dependent from the side housing 3 of the machine.

The spacing of the switches is such that the first limit switch 123 is on the cam 131 when the transfer car is in the product collecting position, the second limit switch 125 is on the cam when the car is in the scrap collecting position, the third limit switch 127 is on the cam when the car is in the product unloading position, and the fourth limit switch 129 is on the cam when the car is in the scrap removal position.

The first three limit switches 123, 125, 127 are roller operated, with contacts closed only while the associated roller is on the cam, while the remaining limit switch 129 is a yoke operated switch with two stable positions. The yoke is a "V" shaped handle 133 pivoted at its vertex with one leg on a lower plane than the other, such that as the switch passes over the cam, the higher leg passes over first and the lower leg rides up on the cam, causing the upper leg to pivot about the vertex, taking a reverse position now lower than the leg on the cam, raising that leg and at the same time reversing the condition of the attached switch electrical contacts. The electrical condition of the switch remains the same until the car is driven over the cam in the opposite direction, re-establishing the original position of the legs of the yoke.

Figure 8:
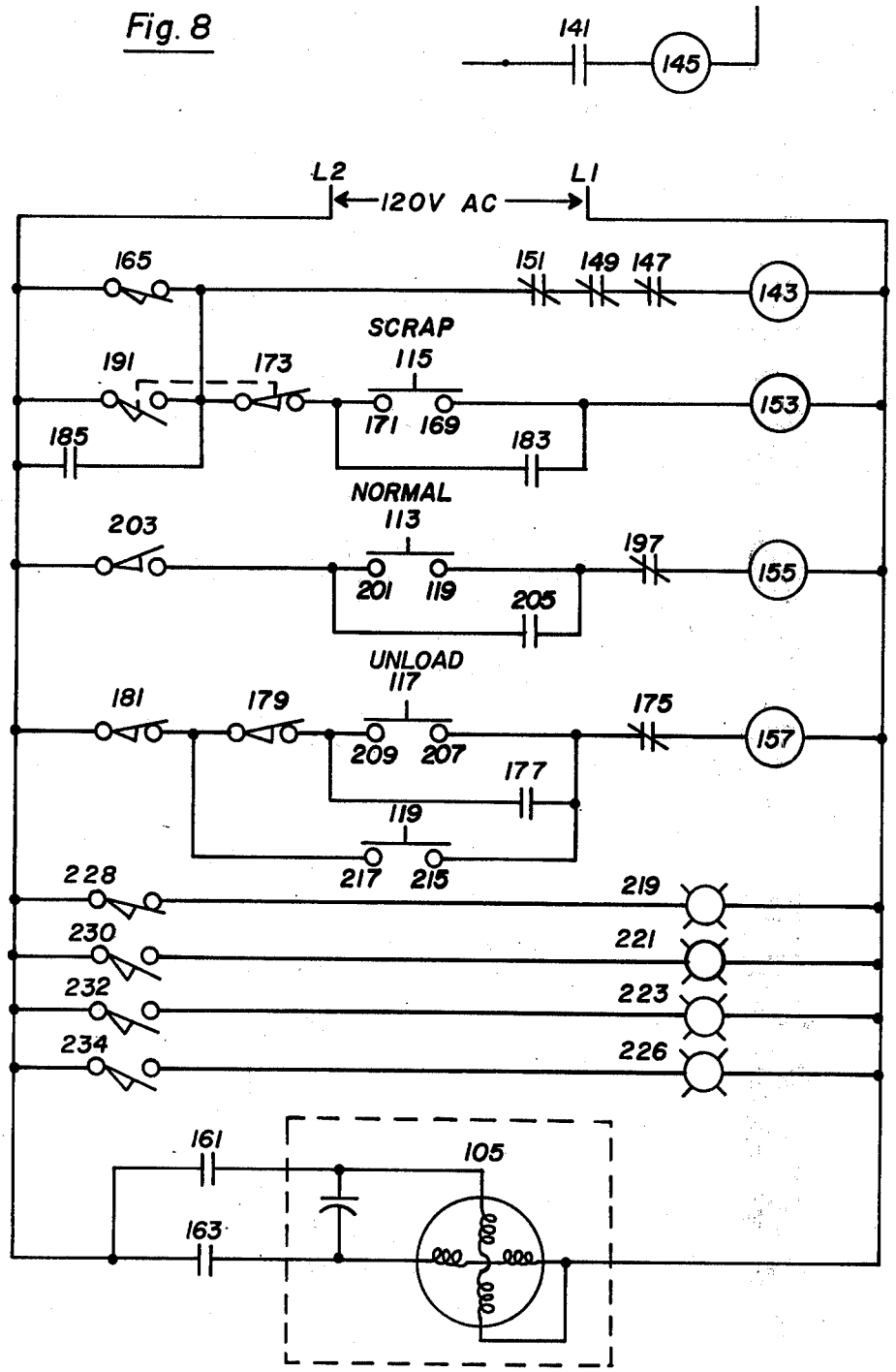
FIG. 8 is an electrical control circuit of a transfer car.

Electrically, refering to FIG. 8, of the drawings, normally open contacts 141 of a shear interlock relay 143 are preferably located within the electrical control circuitry for the shear machine, such as in series with a relay 145 for initiating the downward stroke of the ram, such that the shear machine may not be operated unless such interlock relay circuit is activated. This interlock relay can only be activated when the transfer car is not in motion. Control of the interlock relay in this respect is achieved through normally closed contacts 147, 149 and 151 of a scrap collecting relay 153, a drive-in relay 155, and a drive-out relay 157 respectively, all in series with the interlock relay coil, such that if any of the aforementioned relays are activated, the interlock circuit is not complete and the relay is dropped out.

Power for car movement is derived from the capacitor run, bi-directional motor 105, with normally open contacts 161 of the drive-in relay 155 in series with the motor coil for turning the motor in a direction to drive the car toward the shear, and normally open contacts 163 of the drive-out relay 157 in series with the motor coil to drive the car away from the shear. Activation of the motor in either direction is controlled by picking the appropriate drive-in or drive-out relay.

The electrical circuit, as shown, depicts the condition as would be seen if the car were in the product receiving position with the first limit switch 123 sitting up on the cam, causing the switch to be activated. In this condition, the interlock relay is picked through a circuit from a power source L1, through the relay coil 143, the normally closed contacts 147, 149 and 151 of the scrap collecting relay 153, the drive-in relay 155 and the drive-out relay 157, a set of now closed contacts 165 of the first limit switch and back to the source.

To move the car rearward to the scrap collecting position, depression of the scrap push-button 115 at the control station, will cause the scrap collecting relay 153 to be activated through a circuit from the power source, the scrap collecting relay 153, the contacts of the push-button 169, 171, normally closed contacts of the scrap position limit switch 173, the currently closed first limit switch contacts 165, and back to the source L2. Activating the scrap collecting relay, allows a circuit through the motor drive-out relay 157, from the power source, through normally closed contacts 175 of the motor drive-in relay, now closed contacts 177 of the scrap collecting relay, normally closed contacts 179, 181 of the third and fourth limit switchs respectively, and back to the source, thereby closing contacts 163 of the drive-out relay in the motor circuit causing the reversable motor to drive the car in a rearward direction.

Normally open contacts 183 of the scrap collecting relay are in parallel with the scrap push-button 115, closing when the relay is picked and providing a holding circuit around the push-button so that it need be held down only momentarily.

Also, another set of normally open contacts 185 on the scrap collecting relay, are in parallel with the first limit switch contacts 165 that allowed this relay to be activated initially. When the car starts its rearward movement and the first limit switch 123 rides off of the cam and allows its contacts to open, the normally open contacts of the scrap collecting relay paralleling this switch will close, keeping the scrap collecting relay from dropping out.

Car motion will continue in a rearward direction as long as scrap relay 153 is picked. This relay will remain picked as long as normally closed contacts 173 of the second limit switch, in series with its coil, remain closed. When the car reaches the scrap collecting position, the second limit switch 125 rides up on the cam, opening its normally closed switch contacts 173, allowing the scrap relay 153 to drop out, thus opening the scrap collecting relay contacts 177 in series with the drive-out relay 157, and allowing the drive-out relay to drop-out also, consequently stopping the drive motor.

At this time, another set of normally open contacts 191 of the scrap relay close to provide a new circuit for the interlock relay now that the first limit switch is off the cam and its normally open contacts 165 are open.

To return the car to the normal or product collecting position, depression of the "Normal" push-button 113 will complete a circuit from the power source, through the coil of the motor drive-in relay 155, normally closed contacts of the motor drive-out relay 197, the push-button contacts 199, 201 and a set of the first limit switch contacts 203, which are normally closed when the car is not in the product collecting position, and back to the power source. The push-button need be held down only momentarily, as normally open contacts 205 of the motor drive-in relay parallel the switch and act as a holding circuit while the relay is activated.

Activating the motor drive-in relay, closes contacts 161 in the motor circuit, causing it to turn in a direction to drive the car inward, toward the shear. The car will continue to drive toward the shear until the first limit switch 123 rides up on the cam, opening its contacts 203 in series with the motor drive-in relay, thus stopping the motor.

To drive the car to the product removal position, depression of a third push-button 117 will complete a circuit from the power source, through the drive-out relay 157, normally closed contacts of the motor drive-in relay 175, the push-button contacts 207, 209 and now closed contacts of the third and fourth limit switches 179, 181, and back to the power source. Activating the drive-out relay, again will cause relay contacts in the motor coil circuit to close, causing the motor to drive the car back in a rearward direction. The car will continue to move in this direction while the push-button is held depressed, until the third limit switch 127 rides up on the cam, opening its normally closed contacts 179 in series with the drive-out relay coil 157 causing the relay to drop-out and the motor to stop.

To move the car to a scrap removal position, a fourth push-button 119 is depressed, again completing a circuit through the drive-out relay, from the power source, through the normally closed drive-in relay contacts, the push-button contacts 215, 217 and the normally closed contacts 181 of the fourth limit switch, and back to the source. The car will continue to drive rearward until the fourth limit switch rides up on the cam, opening contacts 181 in series with the motor drive-out relay, dropping out the relay and stopping the drive motor.

Further, rearward movement of the car from its scrap removal position is inhibited by contacts 181 of the yoke operated fourth switch 129 remaining open, disallowing a circuit from the drive-out relay, until the yoke has passed over the cam in the opposite direction.

The indicator light 219 associated with the product collecting push-button 113, the indicator light 221 associated with the scrap collecting push-button 115, the indicator light 223 associated with the product removal push-button 117, and the indicator light 226 associated with the scrap removal push-button 119, are in series respectively with the associated normally open contacts 228, 230, 232 and 234 of the first limit switch 123, the second limit switch 125, the third limit switch 127, and the fourth limit switch 129, such that when the limit switches for the respective positions are closed, the respective indicator lights will light up.

Electrical power and control cables to the movable car to accomplish the above, are supplied and protected via a flexible cable carrier 236 of a type readily purchasable, having flexible supporting links 238 spaced by connecting rods 240 to contain such cables. The movable end 244 of such cable carrier is attached to the front of the car and the stationary end 246 is attached near the track at an optimum point under the machine, while the carrier laying under the car adjacent the track, is drawn along with the car as the car moves to its various positions.

In a second embodiment of the car, in lieu of a forward section for collecting scrap, a pit 225 is provided in the floor, under the knives and extends beyond at least one of the machine side housings 3. In this pit is disposed a hopper 227 for the collection of scrap cuttings. Such a hopper, of substantially the length of shear knives, includes a floor 229 with a pair of outwardly flanged side walls. Coupled to the underside of the floor in proximity to the side walls, are a pair of brackets 233, angled down to receive the ends of a plurality of axles 235 along the length thereof with a pair of gooved wheels 237 rotatably installed on each axle.

A pair of angle iron rails 239 extend substantially the length of the pit in alignment with the complementary grooved wheels of the hopper, to enable the hopper to be moved completely out from under the machine.

To this end, a rope 243 or other suitable material is passed through a snatch-block 245 anchored at the exposed end of the pit, and fastened at one end to the hopper. The hopper may be moved by pulling on the other end of the rope.

A pair of vertical handling slots 247 may be cut in opposing side walls at either end of the hopper at the junction of the wall and the flange, with a pin 249 fastened longitudinally across each slot for receiving the hook 251 of a sling suspended from an overhead crane to lift the hopper from the pit.

Dumping of cuttings from the hopper may be accomplished by lowering the hopper to a surface, disconnecting the sling hooks from one end and raising the still attached end.

With the car driven toward the rear of the machine, scrap cuttings will fall directly into such below floor hopper. To facilitate the cuttings falling inside such hopper and not in between it and the pit, the walls of the hopper being flanged outwardly, are overlapped by guard strips 255 extending inwardly and down from both longitudinal sides of the pit under the machine.

In this second embodiment, a power roll and support assembly 257 is provided to assist in supporting and positioning heavy plate to the rear of the knives, prior to shearing. To this end, such power roll is preferably installed in what corresponds to the previously described scrap receiving section 83 of the car to become a part of the car, and comprises a plurality of wheels or rollers 259 separately affixed to a shaft 261 to form a roller assembly, rotatably mounted between and to one end of a pair of side housings 263, the upper edge of such housings being spanned by a wall 265 having a plurality of short extensions 267 for interleaving between such rollers.

The other end 269 of each of such housings is pivotally connected 271 to a supporting arm 273 mounted adjacent the front wall of the car and including a cylinder-piston assembly 275 for control of the attitude of such power roll and support assembly; the cylinder 277 being connected proximate the lower portion of the arm 273 and the piston 279 connected to a flange 280 depending from intermediate the side housings. The retraction of the piston into the cylinder, rotates the power roll assembly about its pivotal connection 271 in a manner such that the roller end further from the knives is lower than the pivotal end. With the pivotal end, under the knives, the spanning wall 265 constitutes a chute for the product collecting position.

With the piston extended from its cylinder, the power roll assembly rotates about its axis to a position where the rollers are slightly above the plane of any workpiece inserted between the knives of the machine. In the "UP" position, the rollers support such workpiece slightly above the plane of the lower knife, and by applying power to such rollers, heavy work pieces can be positioned within the machine with ease from controls located at the front.

Such cylinder piston assembly 275 is controlled by a valve assembly 281 having an "UP" solenoid 285 and a "DOWN" solenoid 283 in the car's electrical circuit. Activation of the "DOWN" solenoid allows hydraulic fluid to flow through parallel lines into the top of each cylinder while exhausting fluid from the bottom of each cylinder back into the system, driving the piston down with a consequential movement of the chute toward the product collecting position. Conversely, activation of the "UP" solenoid, allows fluid to the bottom of each cylinder, and from the top, back into the system, with a consequentual upward movement of the piston and chute toward a product supporting and adjusting position.

Figure 14:
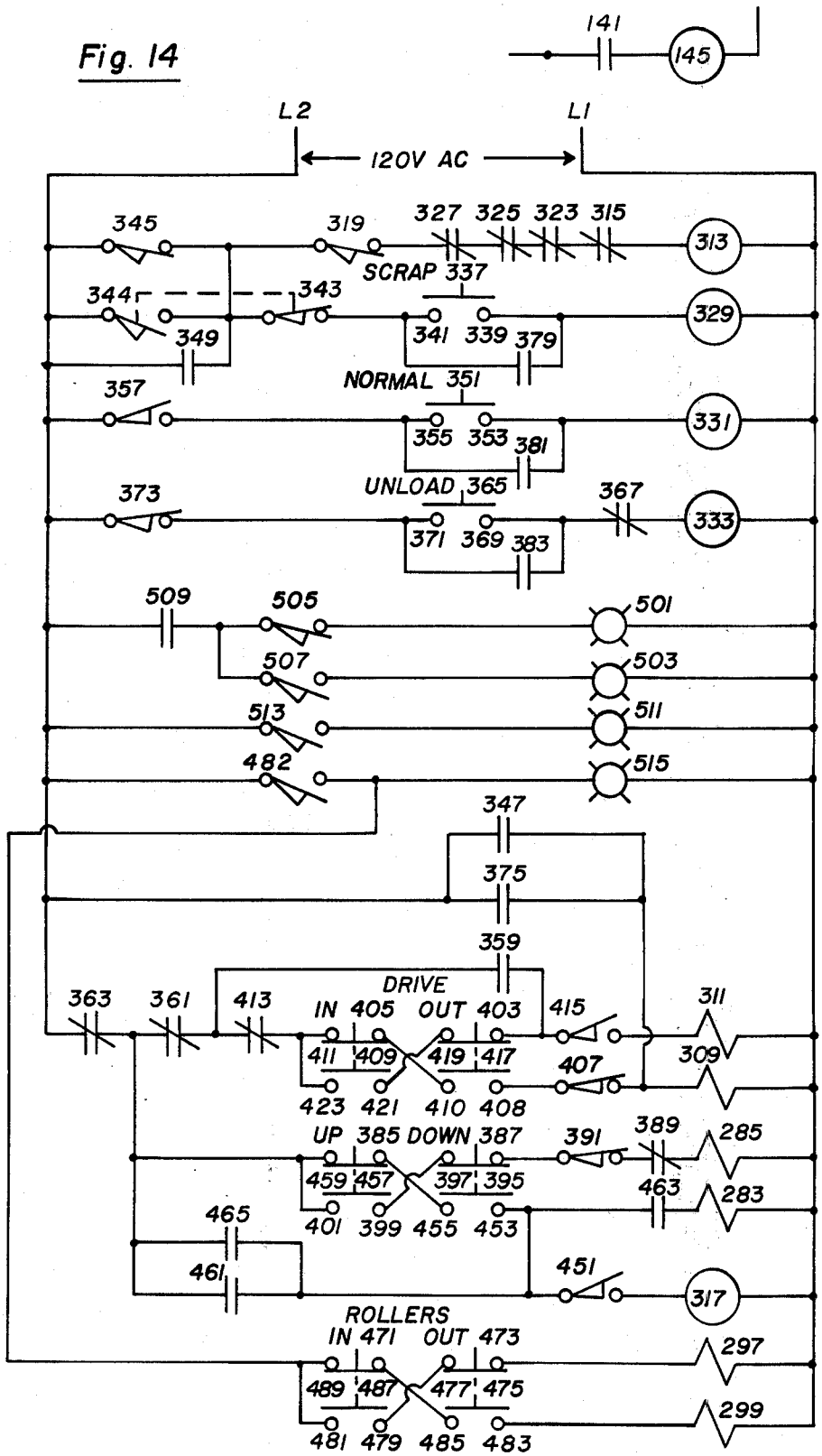
FIG. 14 is an electrical control circuit associated with the hydraulic schematic of FIG. 13.
Figure 16:
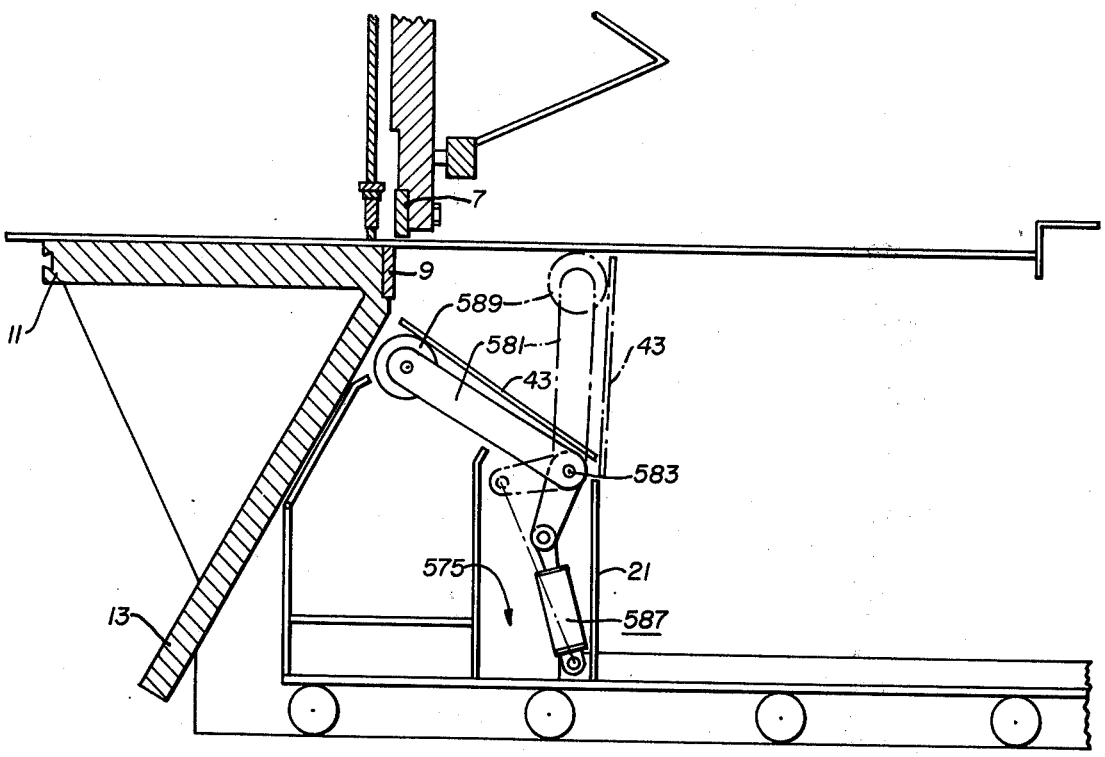
FIG. 16 is a view in section of the transfer car of FIG. 4 shown with a variation of the power roll and support assembly installed.
Figure 17:
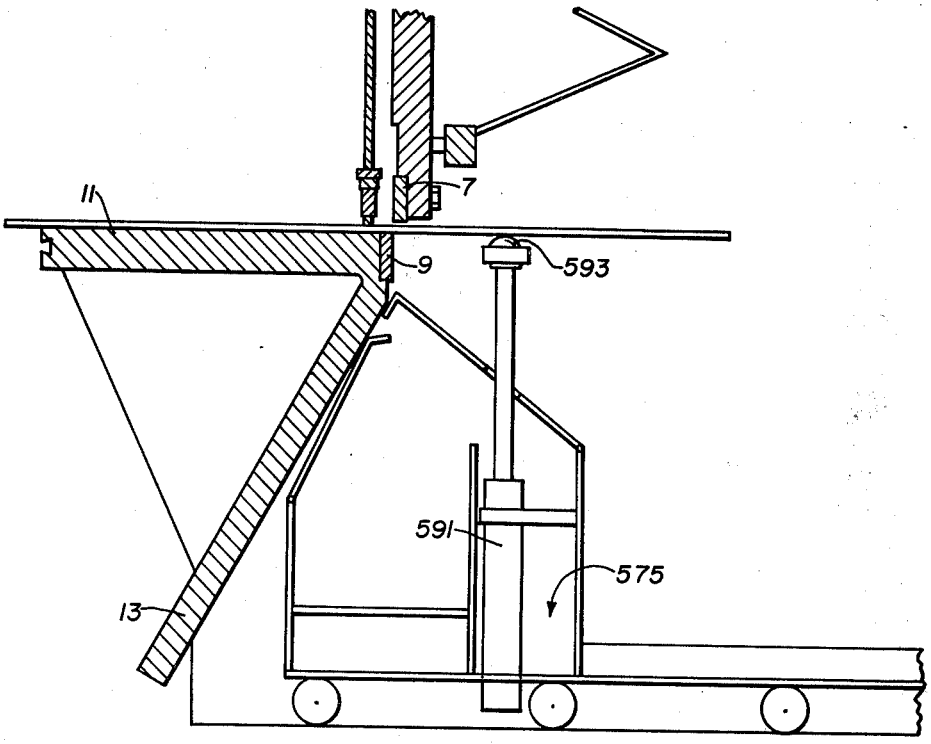
FIG. 17 is a view in section of the transfer car of FIG. 4 shown with ball transfer stands installed.

The rollers 259 are driven by a bi-directional hydraulic torque motor 287, mounted on the inside of one of the side housings 263 in driving engagement with the roller assembly shaft 261. Such a hydraulic motor has two input ports, a first 291 and a second 293, each for driving the motor in a different direction, and operates in conjunction with a control valve assembly 295 having solenoid 297, 299 within the car's electrical control circuit, (FIG. 14) for selectively controlling the supply of hydraulic fluid to the two input ports.

Also, in this embodiment, a similar bi-directional hydraulic torque motor 301 replaces the electric drive motor 105 used in the previous embodiment for powering the car, such motor also having two input ports 303, 305 and a control valve 307 having solenoids 309, 311 in the electrical control circuit.

The electrical circuit for controlling this embodiment is very similar to that described above for the first embodiment.

The circuit for an interlock relay 313 now includes normally closed contacts 315 of a relay 317 activated when the power roller assembly is moving from the support to the chute position, and contacts 319 of a limit switch 321 which closes when such chute is in position as well as contacts 323, 325, 327 of the "scrap" position relay 329 the "drive-in" relay 331, and the "drive-out" relay 333 respectively.

This electrical circuit depicts the transfer car in a product collecting position with the power roll assembly in its chute position, such that contacts of both the first limit switch 123 and the chute in-position limit switch 321 are closed.

Driving the car to the scrap collecting position, which now is a position intermediate the below floor hopper and the product unloading position, becomes a matter of depressing the "scrap" push-button 337, which completes a circuit from the power source L1, through the scrap position relay 329, the contacts 339, 341 of the push-button, normally closed contacts 343 of the second limit switch, currently closed first limit switch contacts 345, and back to the source L2.

Activation of this scrap position relay closes contacts in circuit with the drive-out solenoid 309 of the car control valve assembly 307, from the power source L1, through the solenoid, relay contacts 347 of the "scrap" relay and return to the power source. Energization of the solenoid activates the valve and turns the motor to drive the car rearward.

The "scrap" relay remains activated through a normally open set of its own contacts parallel the first limit switch contacts 345, which open as the car leaves the product collecting position.

Rearward movement continues until the second limit switch is cam activated, breaking the circuit through the "scrap" relay coil by opening closed second limit switch contacts 343.

Concurrent with the opening of contacts 343 of the limit switch and contacts 349 of the scrap relay contacts 344 of the second limit switch close to maintain the circuit for the interlock relay 313.

Return of the car to the product collecting position, is accomplished by depressing a "normal" push-button 351. A circuit is completed through the "drive-in" relay 331 by means of the push-button contacts 353, 355 and the now closed contacts 357 of the first limit switch. Contacts 359 of the "drive-in" relay close and provide a circuit from the drive-in control valve solenoid 311 from the source through drive-in relay contacts 359, normally closed contacts 361, 363 of the chute-down limit switch and drive-out relay respectively, and back to the source.

The car will continue to drive toward the machine until the first limit switch rides up on the cam, indicating the product collecting position, and breaks the drive-in relay 331 circuit by opening the first limit switch contacts 357.

The product unloading position is acheived by depressing the "unload" push-button 365 and completing a circuit through the "drive-out" relay 333 by way of normally closed contacts 367 of the drive-in relay, the push-button contacts 369, 371 and the yoke operated unloading position limit switch contacts 373 which stay closed until the transfer car reaches such unloading position.

Contacts of the activated "DRIVE-OUT" relay again complete a circuit through the first solenoid 309 of the car control valve assembly 307, from the power source, through the solenoid, drive-out relay contacts 375 and back to the source, causing the car to be driven rearward until the unloading position is reached, causing the unloading position limit switch contacts 373 in the push-button circuit to open and drop out the drive-out relay.

All three relays, namely the scrap position, the drive-in, and the drive-out, have normally open contacts 379, 381 and 383 respectively, paralleling their respective activating push-buttons 337, 351 and 356 for the purposes of providing a holding circuit around such push-buttons so that they need be depressed only momentarily.

A pair of push-buttons namely, an "UP" push-button 385 and a "DOWN" push-button 387 provide control for the attitude adjustment of the chute. Depression of the "UP" push-button completes a circuit through the "UP" solenoid 285 controlling hydraulic power to the pistons 279, this by way of normally closed contacts 389 of the chute-down relay, closed contacts 391 of a chute-up limit switch 393, normally closed contacts 395, 397 of the "DOWN" push-button, now closed contacts 399, 401 of the "UP" push-button, contacts 363 of the drive-out relay and back to the source.

The chute will move upward toward the supporting position as long as the push-button is depressed or until it reaches the support position and physically causes the opening of the "chute-up" limit switch contacts 391.

With the chute in the supporting position, control of the car drive system for effectively using the support feature, is assumed through another pair of drive motor control push-buttons 403, 405.

The drive-out push-button 403 when depressed, completes a circuit through the drive-out solenoid 311 of the car control valve assembly by way of normally closed contacts 415 of the unloading position limit switch 129, normally closed contacts of the drive-in push-button 409, 411, and normally closed contacts of the drive-in relay 413, drive-out relay 363, and "chute-down" relay 361.

The car will continue to drive rearward until the button is released or until the furthest or unloading position is reached.

To drive it back in toward the shear for adjustment purposes, the drive-in push-button 405 is depressed, completing a circuit through the drive-in solenoid 311 of the car control valve assembly by way of normally closed contacts 415 of the first limit switch, normally closed contacts 417, 419 of the drive-out push-button, and normally closed contacts 413, 361, 363 of the drive-in relay 331, drive-out relay 333, and chute-down relay 317 respectively.

Again, the car will continue to be driven to any position in a forward direction until the push-button is released or until the forwardmost limit or product collecting position is reached.

The chute is lowered by depressing the "DOWN" push-button 387, completing a circuit from the source, through the "chute-down"relay 317, chute-down limit switch contacts 451 which are closed except when the chute is down, now closed contacts 453, 455 of the "DOWN" push-button, normally closed contacts 457, 459 of the "UP" push-button, and normally closed contacts 363 of the "DRIVE-OUT" relay and back to the cource.

Holding contacts 461 provide a path to keep the "chute-down" relay activated when the push-button is released.

The "chute-down" solenoid 283 may now be activated via a circuit from the source through the solenoid, the now closed contacts 463 of the just picked "chute-down" relay, through holding contacts 461, normally closed contacts 363 of the "drive-out" relay and back to the source, causing the chute to go towards its down position until the contacts 451 of the "chute-down" limit switch 321 are opened when the chute is in the correct position.

Normally open contacts 465 of the "drive-in" relay, close when the car is driving toward the product collecting position; and, if the chute is not at this time in the down position, as indicated by a "chute-down" limit switch contacts 451 being closed, the "chute-down" relay will be activated through a circuit from the source through the relay 317, limit switch contacts 451, "drive-in" relay contacts 465, and normally closed "drive-out" relay contacts 363 to the source.

Thus, the chute is assured of being in the down position whenever the product collecting position is approached.

However, with the chute in its "UP" or supporting position and with the workpiece resting upon the rollers 259, positioning adjustments of such workpiece may readily be made by rotating such rollers.

Sucn rotation is controlled by another pair of push-buttons 471, 473 in the electrical circuitry, which activate the appropriate motor control solenoid. Depressing a "roller-in" push-button 471 completes a circuit from the source through the roller drive-in solenoid 297, normally closed contacts 475, 477 of the "roller-out" push-button, contacts 479, 481 of the "roller-in" push-button, contacts 482 of the "chute-up" limit switch 393 and back to the source; the picked solenoid 297 activating the control valve 295 to cause the motor 287 to drive the rollers inwardly.

The rollers will continue to rotate inwardly until the push-button is released.

Depression of the "roller-out" push-button 473 similarly causes rotation in the opposite direction by completing a circuit through the roller drive-out solenoid 299 by way of contacts 483, 485 of "roller-out" push-button, contacts 487, 489 of the "roller-in" push-botton, closed contacts 482 of the "chute-up" limit switch and back to the source, causing the control valve to cause motor rotation outwardly.

Again, the circuit will remain complete and the rollers will continue to drive until the button is released.

Indicator lights 501, 503 indicating the product collecting position or the scrap receiving position, have circuits completed by contacts 505, 507 on the product collecting position limit switch and scrap collecting limit switch respectively when contacts 509 of the interlock relay 313 are closed and the car is in one of those positions.

An indicator light 511 is lit when the car is in the product removal position and contacts 513 on the product removal position limit switch are closed.

An indicator 515 to indicate when the chute is up, lights when the "chute-up" limit switch contacts 482 are closed.

The above described circuitry thus permits of controlling the car and all its aforedescribed associated functions.

Figure 11:
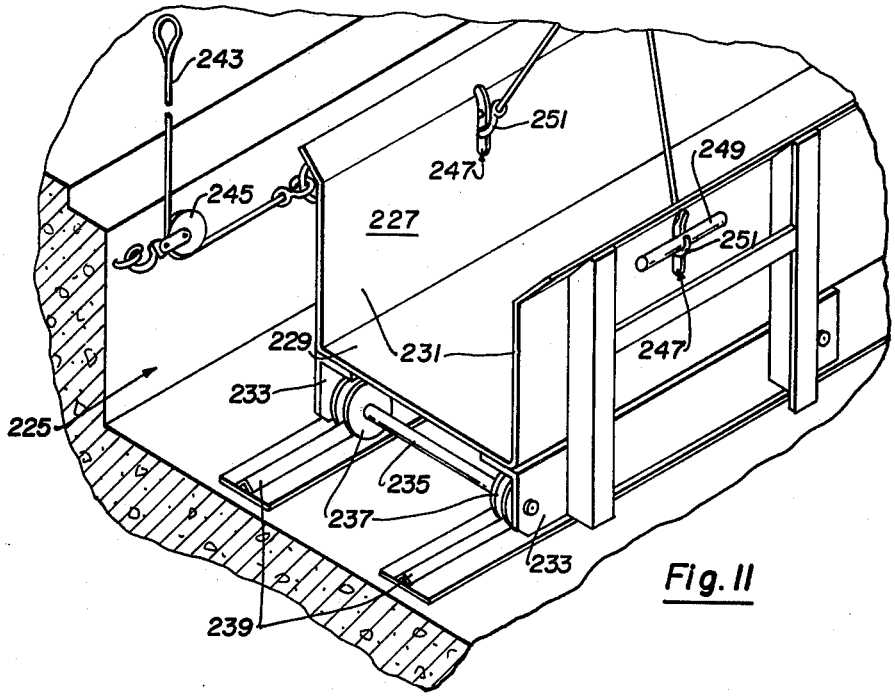
FIG. 11 is a three dimentional view of a below-floor-hopper employed in FIG. 10.
Figure 10:
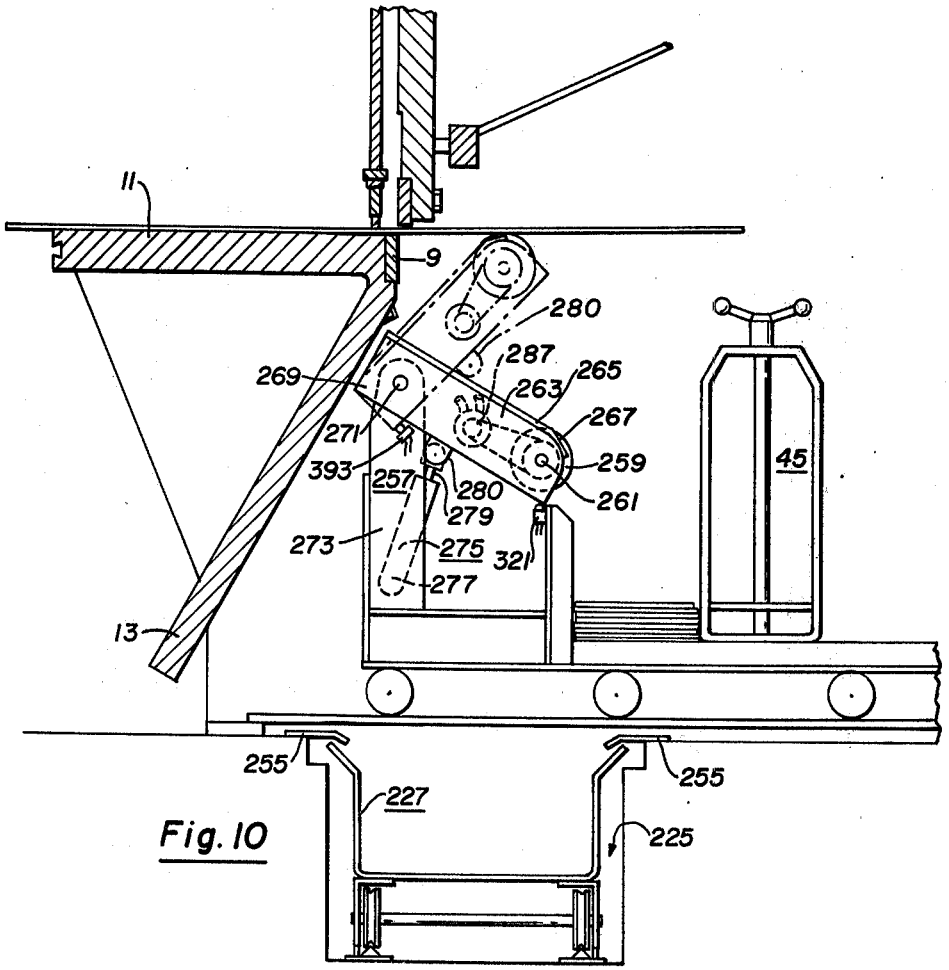
FIG. 10 is an end view partly in section through a transfer car and shear machine showing additional features and modifications of the invention.
Figure 12:
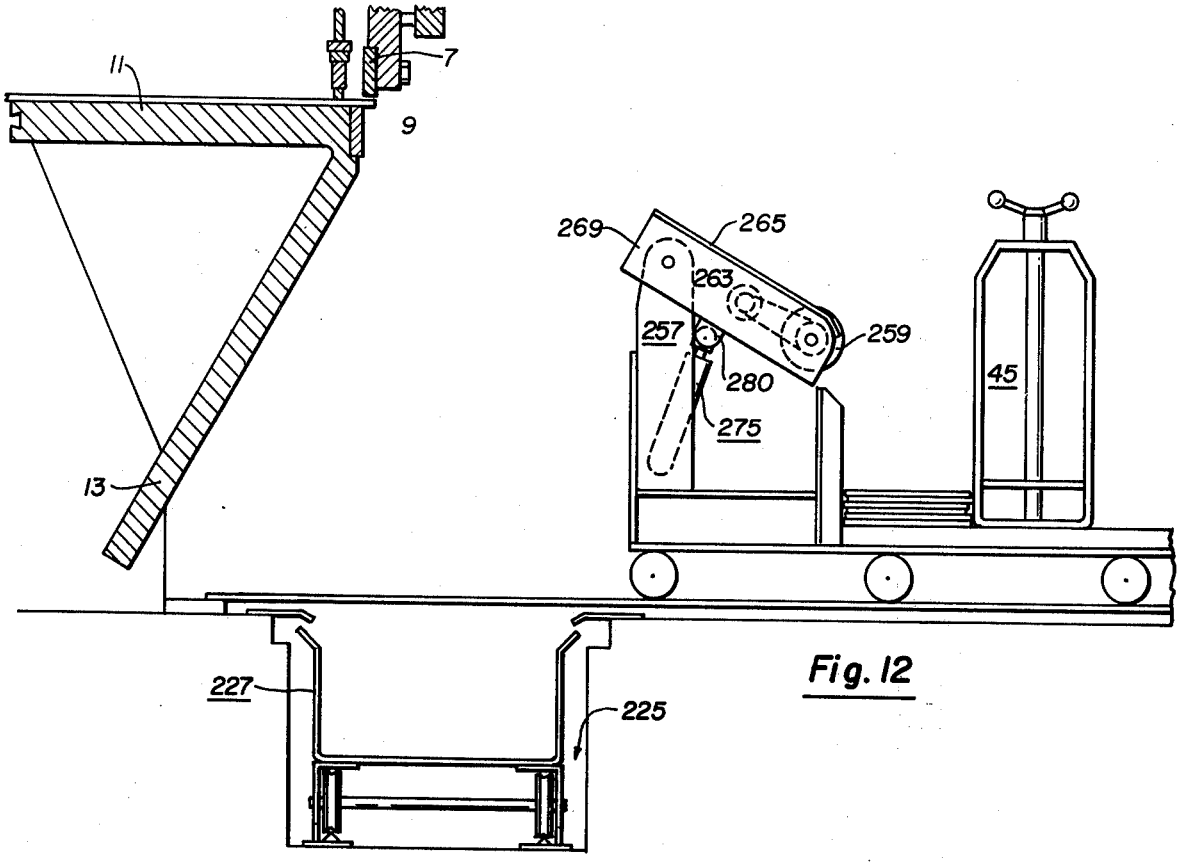
FIG. 12 is a view in section of the shear machine corresponding to FIG. 10 showing the transfer car in a scrap collecting position.
Figure 15:
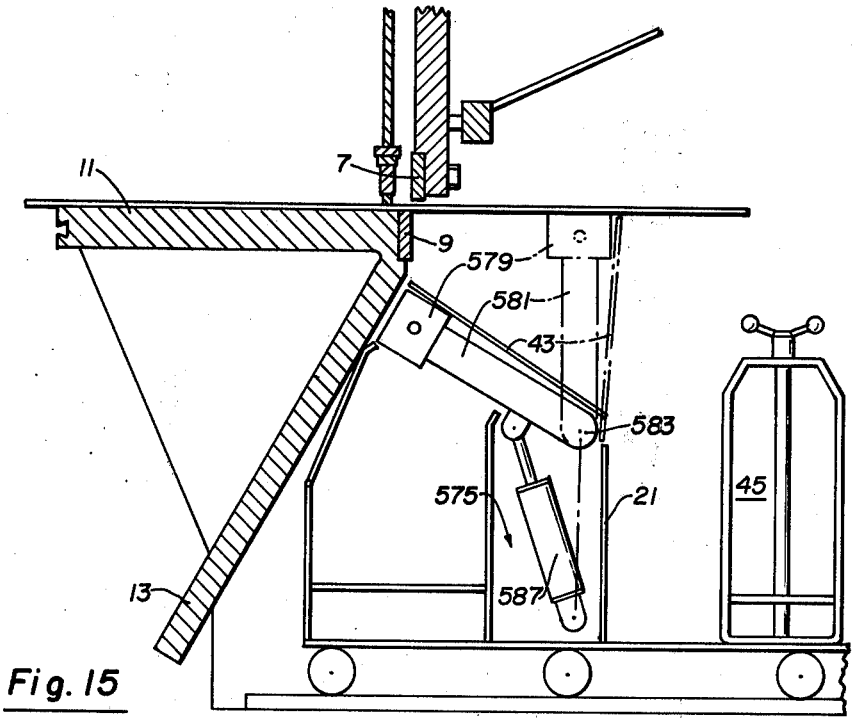
FIG. 15 is a view in section of the transfer car of FIG. 4 shown with a support and magnetic grip assembly installed.
Figure 13:
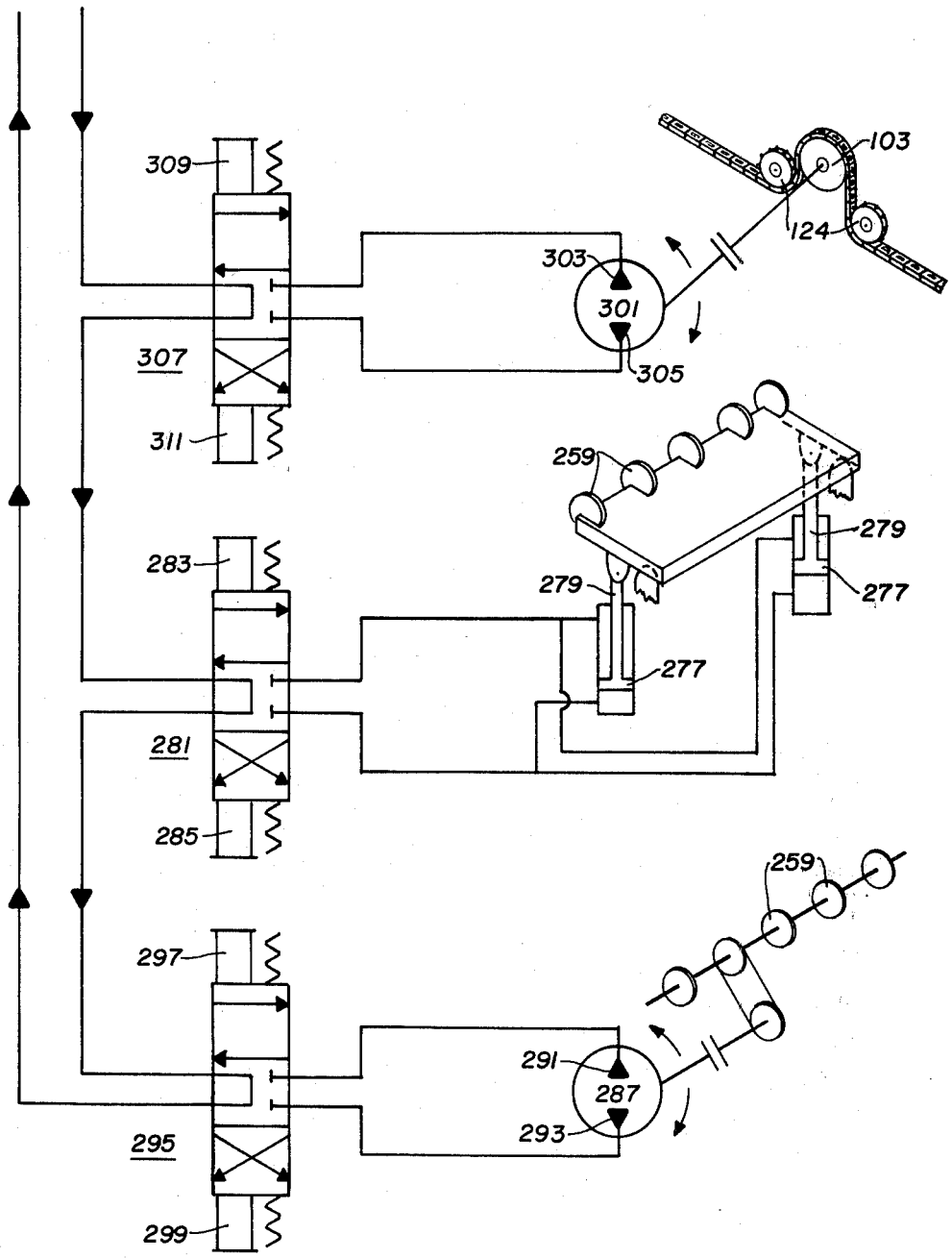
FIG. 13 is a hydraulic circuit schematic for the transfer car of FIG. 10.
Figure 19:
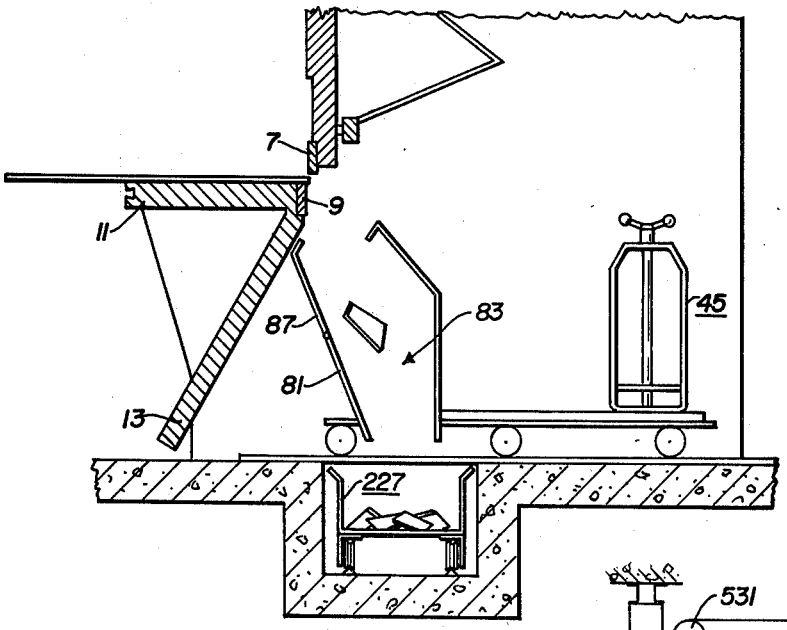
FIG. 19 is a view in section of a two section transfer car in association with a below-floor scrap hopper.

To facilitate the guidance of scrap cuttings into the below floor hopper 227 of FIGS. 11 and 12, another configuration might be as shown in FIG. 19, with an under floor hopper in combination with a car having the floor of the scrap receiving section 83 removed, utilizing the walls of the section to guide such scrap cuttings into the under floor scrap hopper.

Figure 6:
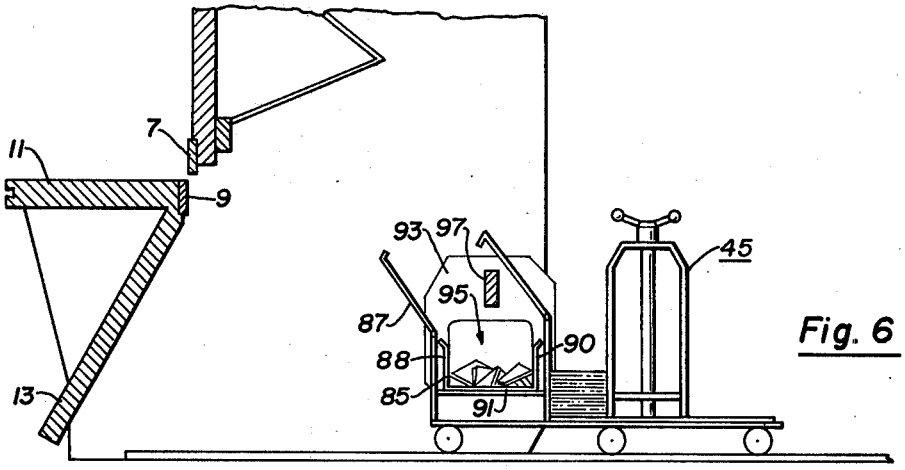
FIG. 6 is a view in section of a transfer car in a product unloading position.
Figure 20:
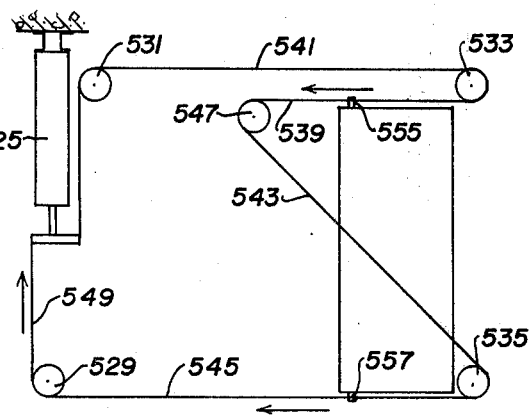
FIG. 20 is a schematic of an alternate drive system for a transfer car.

In lieu of the drive system depicted in FIGS. 4, 5 and 6 of the drawings, the drive means might be as in FIG. 20 whereby a pneumatic or hydraulic cylinder 525 associated with a cable or chain system 527 is used to provide mobility by moving the car to the various positions behind the shear.

The cable or chain is essentially arranged over four pulleys 529, 531, 533, 535 in rectangular fashion surrounding the car, with the end of the side 539 toward the rear of the car deformed inwardly until it has defined a path parallel to its closest adjacent side 541 with an angular leg 543 to its furtherest adjacent side 545 and fixed into this position with a fifth pulley 547.

The hydraulic cylinder 525 attached to the cable side 549 toward the front of the car, controls cable movement around the pulleys. It can be seen that a point 555 on the cable along the parallel path and a similar point 557 on the cable on the furtherest adjacent side 545, move parallel and in the same direction in response to any action of the hydraulic or pneumatic cylinder. Therefore, an effective drive means is accomplished by connecting such points 555, 557 of the cable drive system to points on either side of the moveable car.

Figure 18:
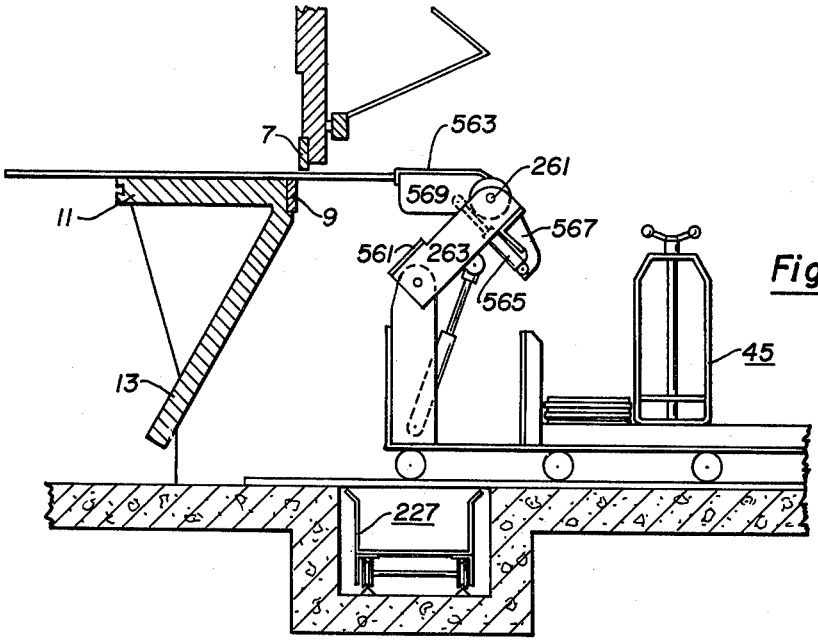
FIG. 18 is a view in section of the transfer car of FIG. 11 with a back-gauge stop feature installed.

An additional feature of our invention is an adjustable back-gauging feature which may be added to the power roll assembly as shown in FIG. 18. The spanning wall or chute 265 of the power roll assembly is divided into two sections, the first section 561 firmly fixed to the side housings 263 and the second 563 pivotably mounted to the roller shaft 261, pivotal about such shaft from a position in the plane of the first section where it serves as part of the chute, to a position intercepting the plane of any work piece inserted in the machine. Adjustments of the back-gauge may now be effected by controlled movements of the car.

The pivoting of the second section is accomplished by means of piston assemblies 565 attached between bracket 567 from the roller end of the side housings 263 and a support 569 under such second section, with power and control preferably supplied from circuits similar to the aforedescribed power roller and support.

As a further feature, the cars of the previous embodiments may have an intermediate section 575, housing an electro-magnetic support and grip assembly including an electro-magent 579 affixed on the end of a rotatable support arm 581, pivotal about an axis 583 adjacent the rear of such intermediate section. The hinged upper segment 43 of the dividing wall 21 still functions as a chute when the car is in the product collecting position, but rotates upward and out of the way, when the support arm is rotated upward into a support or gripping position.

When in such supporting position, work inserted into the machine rests on the magnetic head behind the knives. To position such work, a D.C. current is applied to the electro-magnet causing it to grip the work, while adjustments of the car position is made.

A piston assembly 587 attached between the floor of the car and the support arm along with hydraulic and electrical circuits and controls similar to those of the aforementioned power roll and support assembly, can provide external control by an operator for effecting such adjustments.

A modification to the above, might be a roller 589 on an end of the support arms 581 in lieu of the electro-magnet 579. Such a roller may or may not be power driven, but when in the supporting position, will aid in adjusting work prior to shearing.

Another feature comprises hydraulic or pneumatic ball transfer stands 591 which may be installed within such intermediate section below the hinged upper segment of the dividing wall, such that ball rollers 593 may be raised through openings in such hinged section to provide support for work during positioning. After positioning, the ball transfer stands are lowered prior to shearing.

The use of a car without drive power is within the broad concept of the present invention, such car being movable either manually or with some externally applied power such as a fork lift or tractor.

While we have illustrated and described our invention in its preferred forms, it will be apparent that the same is subject to alteration, modification and additions without departing from the underlying principles involved and we therefore do not desire to be limited in our protection to the specific details illustrated and described except as may be necessitated by the appended claims.

We claim:

1. In combination, a machine for performing an operation on work in the course of which it may produce a work product or scrap product, said machine having a pair of side housings spanned by work modifying means, a movable product car having means thereon for movably supporting the car on a supporting surface, and having means thereon defining a product receiving and supporting section, including a bottom and sides, for receiving and supporting product therein for movement with said car when the car is moved on said supporting surface, said car being movable to a position between said side housings to receive and support the product of said machine in said section, means for guiding such product from the machine into said section of said movable car, and positive drive means for adjustably moving said product car and the product supported therein from a position between said side housings to a position readily accessible for subsequent disposition of said work product.

2. In combination, a machine for performing an operative on work in the course of which it may produce a work product or a scrap product, said machine having a pair of side housings spanned by work modifying means, a movable car between said side housings, and means included in said car for enabling said car to cooperate with said machine in supplementing the operation thereof, said means included in said car comprising a section into which said work product may be guided and supported as part of said work operation, said product section of said car including support means for supporting the work product and having a front wall having an upper portion inclined toward said work modifying means to function as a chute to guide such work product to said product section, and means for adjustably moving said car and the work product supported therein away from the machine for subsequent disposition of said work product.

3. A combination in accordance with claim 1, characterized by said product section of said car including back-stop means adjacent the rear of said car, and means for adjusting said back-stop means to adjust the length of said product section to approximately the width of said work product.

4. A combination in accordance with claim 1, characterized by said product section of said car including side guide means supported in proximity to the front wall of said product section and means for adjusting said side guide means along the front wall to adjust the width of said product section to approximately the length of said work product.

5. A combination in accordance with claim 4, characterized by said side guide means including an upper sloping portion for guiding said work product into stacking relationship within said product section.

6. A combination in accordance with claim 1, charaterized by said machine having a work table to the front and extending to said work modifying means, and a lower front wall of said machine extending under said table in communication with the spacing between said side housings, said lower wall enabling said car to move under said work modifying means whereby, said product may have a steep approach to said product section.

7. A combination in accordance with claim 6, characterized by said work modifying means including an upper and lower knife in shearing relationship to each other and between which sheet metal may be fed from the front of said machine toward the rear thereof, said car including a section adjacent said product section into which scrap product may be guided, and means for selectively guiding work product to said product section and scrap product to said scrap section.

8. A combination in accordance with claim 7, characterized by said section into which scrap product may be guided including a front wall having an upper portion capable of being moved through an angle about an axis, means normally biasing said upper portion toward said work modifying means when said movable car is in a position to receive scrap product, said upper portion, when said car is moved under said lower wall, to a work product collecting position, responding to engagement with said sloping wall to substantially close said scrap product collecting section.

9. A combination in accordance with claim 1, characterized by said work modifying means including an upper and lower knife in shearing relationship to each other and between which sheet metal may be fed from the front of said machine toward the rear thereof, said car including a section adjacent said product section into which scrap product may be guided, and means for selectively guiding work product to said product section and scrap product to said scrap section.

10. A combination in accordance with claim 9, characterized by said section into which scrap may be guided including a bucket for collecting such scrap, said bucket comprising a front wall, a back wall and a bottom to form a trough, and end walls with a discharge opening in at least one of said end walls, whereby said bucket may be removed from said car and scrap may be emptied through said discharge opening.

11. A combination in accordance with claim 10, characterized by said bucket having a bail between said end walls, said bail having openings for reception of lift means, whereby said bucket may be gripped for removal by said lift means.

12. A combination in accordance with claim 9, characterized by said section into which scrap may be guided having a bottom opening, said combination including a pit below and parallel to said work modifying means, and a hopper in said pit for the collection of scrap cuttings guided thereto through the bottom of said section.

13. A combination in accordance with claim 1, characterized by said car including a front section for the collection of such scrap product and a rear section for the collection of such work product, said front and rear sections separated by a dividing wall including an upper hinged segment functioning as a chute for guiding work product over said scrap product section for collection into said work product section.

14. A movable car in accordance with claim 13, characterized by said scrap product collecting section including a front wall having an upper hinged section capable of being moved through an angle about an axis means, when used with such shear machine, for normally biasing said hinged section toward such shear machine when said movable car is in position to receive scrap product; said hinged section, when said car is moved to such front lower wall to a product collecting position, responding to engagement with such front lower wall to substantially close said scrap collecting section.

15. A movble car in accordance with claim 13, characterized by said product collecting section including back-stop means adjacent the rear of said car, and means for adjusting said back-stop means to adjust the length of said work product section to approximately the width of said work product.

16. A movable car in accordance with claim 13, characterized by said product collecting section of said car including side guide means supported in proximity to said dividing wall of said car, and means for adjusting said side guide means along said dividing wall to adjust the width of said work product section to approximately the length of said work product.

17. A movable car in accordance with claim 16, characterized by said side guide means including an upper sloping portion for guiding said work product into stacking relationship within said work product section.

18. A movable car in accordance with claim 16, characterized by said movable car including wheels, and drive means on said car to move said car on said wheels.

19. A combination in accordance with claim 1, characterized by said car including work supporting means for supporting work in preparation for performing such operation on work.

20. A combination in accordance with claim 19, characterized by said work supporting means including adjusting means for adjusting such work while supported thereby.

21. A combination in accordance with claim 20, characterized by said adjusting means including rollers on said work supporting means, whereby said supported work may be manually adjusted on said rollers prior to such work operation.

22. A combination in accordance with claim 20, characterized by said adjusting means including balls on said work supporting means whereby, said supported work may be manually adjusted on said balls prior to such work operation.

23. A combination in accordance with claim 20, characterized by said adjusting means including power operated rollers on said work supporting means, whereby such supported work may be power adjusted prior to such work operation.

24. A combination in accordance with claim 20, characterized by said adjusting means including magnetic gripping means, whereby said magnetic gripping means is conjunction with movement of said car can affect such adjustment of work.

25. A combination in accordance with claim 1, characterized by a pit below and parallel to said work modifying means, and a hopper in said pit for the collection of cuttings.

26. A combination in accordance with claim 25, characterized by said hopper including wheels for movement within said pit and means for removing said hopper from said pit to effect removal of said cuttings.

27. A combination in accordance with claim 1, characterized bysaid movable car including a back-gauging means for said work.

28. A combination in accordance with claim 1, characterized by said car included means comprising cable drive means for providing mobility to said movable car.

29. In combination: a machine for performing an operation on work in the course of which it may produce a work product or a scrap product, said machine having a work table and a lower front wall; and a movable product car having a product receiving and supporting section and a scrap receiving and supporting section, said car being movable to a position adjacent said lower front wall of the machine for receiving product from the machine, and said car including means responsive to movement of said car toward and away from the lower front wall of the machine to selectively guide said product either into said work product receiving section or said scrap product receiving section, depending upon the position of said car relative to said lower front wall of the machine, and said car being movable away from said machine to convey product supported therein to a location for subsequent disposition of the product.

* * * * *